US007088308B2

(12) United States Patent
Delgado et al.

(10) Patent No.: US 7,088,308 B2
(45) Date of Patent: Aug. 8, 2006

(54) FEEDBACK AND CONTROL SYSTEM FOR RADOMES

(75) Inventors: Heriberto Jose Delgado, Melbourne, FL (US); William D. Killen, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 133 days.

(21) Appl. No.: 10/681,712

(22) Filed: Oct. 8, 2003

(65) Prior Publication Data

US 2005/0078048 A1 Apr. 14, 2005

(51) Int. Cl.
*H01Q 1/42* (2006.01)

(52) U.S. Cl. ..... 343/872; 343/770

(58) Field of Classification Search ..... 343/720, 343/753, 770, 872, 895
See application file for complete search history.

(56) References Cited

U.S. PATENT DOCUMENTS

| | | | | |
|---|---|---|---|---|
| 3,581,243 | A | 5/1971 | Alford | |
| 3,681,716 | A | 8/1972 | Chiron et al. | |
| 4,638,271 | A | 1/1987 | Jecko et al. | 333/205 |
| 4,967,171 | A | 10/1990 | Ban et al. | 333/116 |
| 5,307,077 | A * | 4/1994 | Branigan et al. | 343/720 |
| 5,371,505 | A * | 12/1994 | Michaels | 342/360 |
| 5,600,325 | A | 2/1997 | Whelan et al. | 342/13 |
| 5,708,679 | A * | 1/1998 | Fernandes et al. | 375/259 |
| 5,714,112 | A | 2/1998 | Hazeyama et al. | 264/675 |
| 5,724,052 | A | 3/1998 | Boulingre et al. | 264/675 |
| 6,124,832 | A * | 9/2000 | Jeon et al. | 343/711 |
| 6,424,308 | B1 | 7/2002 | Wu et al. | 343/753 |
| 2003/0043085 | A1 * | 3/2003 | Park et al. | 343/770 |

FOREIGN PATENT DOCUMENTS

| | | |
|---|---|---|
| EP | 0 754 660 A1 | 1/1997 |
| EP | 1 089 374 A2 | 4/2001 |
| EP | 1 108 533 | 6/2001 |
| JP | 56-123102 | 9/1981 |
| JP | 05-211402 | 8/1983 |
| JP | 07-015218 | 1/1995 |
| JP | 08-154006 | 6/1996 |
| JP | 08 307117 | 11/1996 |
| JP | 10/190321 | 7/1998 |
| JP | 2000307362 | 11/2000 |
| WO | WO 01-01453 A2 | 1/2001 |

OTHER PUBLICATIONS

U.S. Appl. No. 10/439,094, filed May 15, 2003, Delgado et al.
U.S. Appl. No. 10/448,973, filed May 30, 2003, Delgado et al.
U.S. Appl. No. 10/654,153, filed Sep. 3, 2003, Delgado et al.

(Continued)

*Primary Examiner*—Tuyet Vo
*Assistant Examiner*—Jimmy Vu
(74) *Attorney, Agent, or Firm*—Sacco & Associates, PA; Robert J. Sacco

(57) ABSTRACT

Method for dynamically optimizing radome (110) performance. The method can include the steps of sensing (405) at least one parameter defining a performance characteristic of the radome (110). At least one electrical characteristic of the radome (110) can responsively be varied to dynamically modify the performance characteristic. For example, the electrical characteristic can be varied by application of an energetic stimulus (440) to the radome (110).

16 Claims, 8 Drawing Sheets

OTHER PUBLICATIONS

Marques, Ricardo; Medina, Francisco; and Rafii-El-Idrissi, Rachid; "Role of bianisotropy in negative permeability and left handed metamaterials" The American Physical Society, p. 65. <http://physics.uscs/~drs/publications/marques_prb_2002.pdf>.

Itoh, T.; et al: "Metamaterials Structures, Phenomena and Applications" IEEE Transactions on Microwave Theory and Techniques; Apr. 2005; [Online} Retrieved from the Internet: URL:www.mtt.org/publications/Transactions/CFP_Metamaterials.pdf>.

Kiziltas, G.; et al: "Metamaterials design via the density method" IEEE Antennas and Propagation Society Int'l Symposium 2002, vol. 1, Jun. 16, 2002 pp. 748-751, Piscataway.

Salahun, E.; et al: "Ferromagnetic composite-based and magnetically-tunable microwave devices" IEEE MTT-S Microwave Symposium Digest, vol. 2, Jun. 2, 2002 pp. 1185-1188.

* cited by examiner

FEEDBACK AND CONTROL SYSTEM FOR RADOMES

BACKGROUND OF THE INVENTION

1. Technical Field

The present invention relates to the field of radomes and, more particularly, to radome feedback and control systems.

2. Description of the Related Art

Radomes are dome-like shells that are substantially transparent to radio frequency radiation. Functionally, radomes can be used to protect enclosed electromagnetic devices, such as antennas, from environmental conditions such as wind, solar loading, ice, and snow. Conventional radome types include sandwich, space frame, solid laminate, and air supported.

Radome induced wave perturbations are a principal consideration in radome construction. An ideal radome is electromagnetically transparent to a large number of radio frequencies, through a wide range of incident angles. However, in practice, conventional radomes are inherently lossy and are narrowbanded. Moreover, loss generally increases with angle of incidence. Traditionally, the radio frequency loss in radomes is minimized by adjusting the physical and electrical characteristics of the radome at the time of manufacture to achieve desired performance characteristics. For example, conventional radomes are often formed from a dielectric material having a thickness of a multiple of half a wavelength at a selected frequency. When so formed, a very small reflection coefficient will result at that frequency. Unfortunately, such a radome transmits electromagnetic waves with minimal loss only over a narrow frequency band about the selected frequency.

In order to overcome this limitation, some radomes are made of several layers, so that a broader group of frequencies can be transmitted with low loss. These multilayered radomes, still only have performance characteristics resulting in low reflections over a small set of pre-established frequencies and incident angles.

Accordingly, conventional radomes have a set of performance characteristics that are fixed at the time of their manufacture. The performance characteristics cannot be dynamically altered or modified as operational conditions change. The operational conditions can change based on any number of criteria such as technological upgrades, standard changes, and/or redistribution of portions of the electromagnetic spectrum.

SUMMARY OF THE INVENTION

The invention concerns a method for dynamically optimizing radome performance. The method can include the steps of sensing at least one parameter defining a performance characteristic of the radome. For example, the parameter can be an incident radio frequency signal, a reflected radio frequency signal, and/or a transmitted radio frequency signal. The parameter can also be a reflection coefficient, a transmission coefficient, a radome temperature, a polarization of incident waves, and/or an angle of wave incidence. After the parameter is sensed, at least one electrical characteristic of the radome can be selectively varied to dynamically modify the performance characteristic. The performance characteristic can be a transfer characteristic.

According to one aspect of the invention, the electrical characteristic can include a permittivity, a permeability, a loss tangent, and/or a reflectivity. The electrical characteristic can be varied by application of an energetic stimulus to the radome. In one embodiment, the energetic stimulus will vary the electrical characteristic for only a selected portion of the radome. In another embodiment, the energetic stimulus can include an electrical stimulus, a photonic stimulus, a magnetic stimulus, and/or a thermal stimulus.

The invention also concerns a radome. The radome includes a sensor for sensing at least one parameter defining a performance characteristic of the radome. The sensor can sense radio frequency energy. The parameter can be reflected radio frequency energy, transmitted radio frequency energy, a radome temperature, a polarization of incident waves, and/or an angle of wave incidence. A control system is also included within the invention for selectively varying at least one electrical characteristic of the radome to dynamically modify the performance characteristic. The electrical characteristic can include a permittivity, a permeability, a loss tangent, and/or a reflectivity.

According to one aspect of the invention, the control system can further include a control processor configured to determine at least one control action based in part upon the parameter. The electrical characteristic of the radome can be varied in response to an energetic stimulus. The energetic stimulus can be an electrical stimulus, a photonic stimulus, a magnetic stimulus, and/or a thermal stimulus.

According to one aspect of the invention, the radome can include a dome wall. At least a portion of the dome wall can be comprised of a magnetic material. The magnetic material can include a ferroelectric material, a ferromagnetic material, a ferrite, and/or a liquid crystal polymer (LCP).

BRIEF DESCRIPTION OF THE DRAWINGS

There are shown in the drawings embodiments, which are presently preferred, it being understood, however, that the invention is not limited to the precise arrangements and instrumentalities shown.

DETAILED DESCRIPTION OF THE INVENTION

The invention disclosed herein includes a method and a system which couples a feedback and control system with an active radome. The feedback and control system can monitor radome performance and provide control signals to dynamically adjust the active radome performance characteristics.

Figure 1:
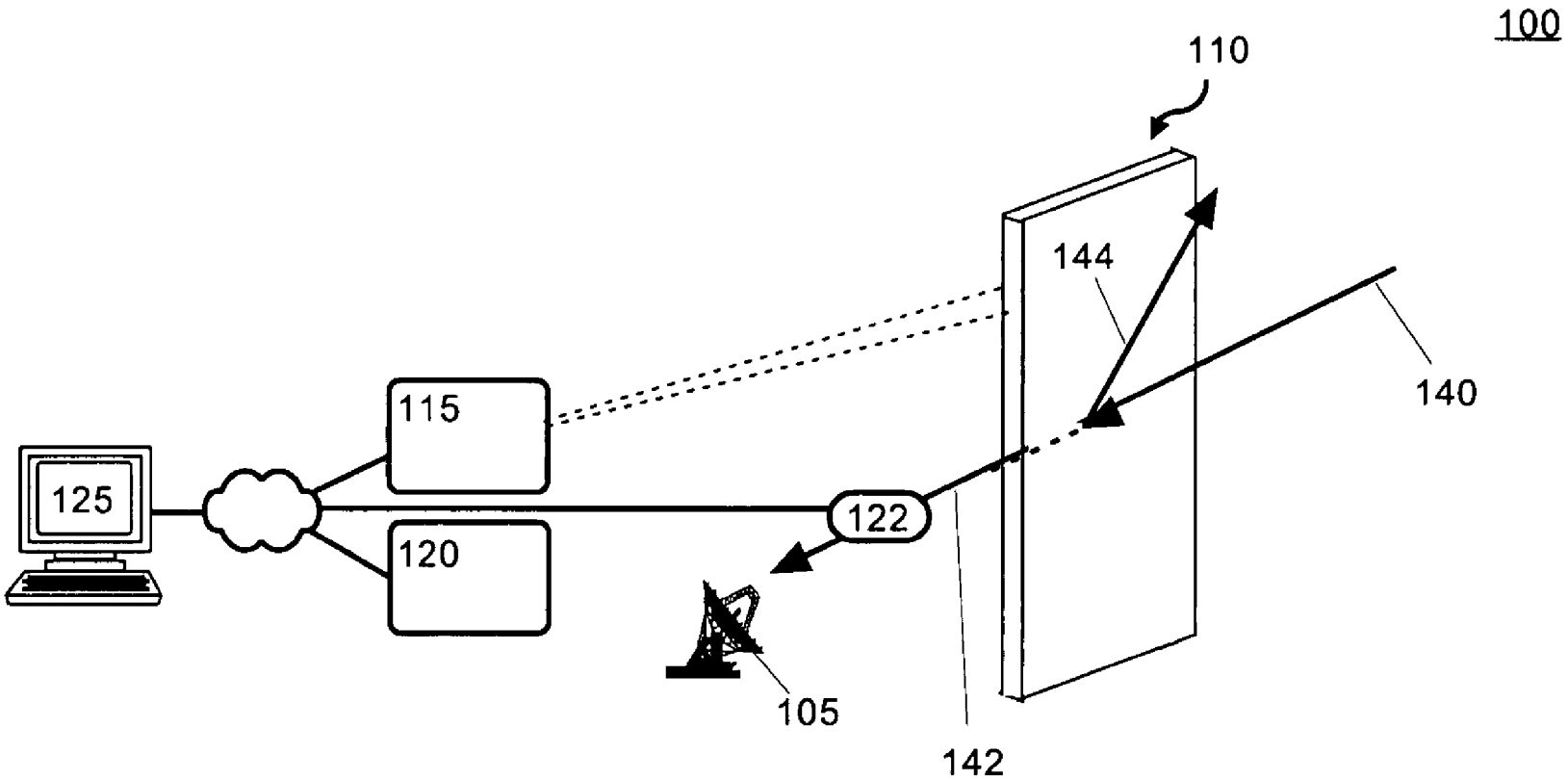
FIG. 1 is a drawing that shows an exemplary active radome.

FIG. 1 is a schematic diagram of a system 100 including an active radome in accordance with an embodiment of the invention. The system 100 can include a protected electromagnetic device 105, a radome 110, a stimulus generator 115, a stimulus controller 120, a sensor 122, and a control processor 125. The electromagnetic device 105 can be an apparatus, such as an antenna, designed to receive and/or transmit electromagnetic waves.

The radome 110 can be a shell that protects the enclosed electromagnetic device 105 from environmental conditions without substantially interfering with selected electromagnetic waves passing through the radome 110. For example, an incoming wave 140 can strike the radome 110 resulting in a transmitted wave 142 and a reflected wave 144. If the incoming wave 140 represents a desired signal, the energy contained within transmitted wave 140 should be maximized while the reflected wave 144 minimized. Alternately, if the incoming wave 140 represents an undesired signal, such as noise, then the transmitted wave 140 should be minimized while the energy within the reflected wave 144 maximized.

The radome 110 can be formed from a dynamic material having electrical characteristics that can be selectively altered through the application of an energetic stimulus. Electrical characteristics as used herein can refer to a permittivity, a permeability, a loss tangent, and/or a reflectivity of the radome 110.

Many different dynamic materials can be used to form the radome 110. For example, in one embodiment, the dynamic material of the radome 110 can comprise a liquid crystal polymer (LCP) having electrical characteristics that can be selectively varied by applying a photonic stimulus, a thermal stimulus, an electric stimulus, and/or a magnetic stimulus. In another embodiment, the dynamic material can comprise a composite dielectric material that includes magnetic particles, such as ferroelectric particles, ferromagnetic particles, and/or ferrite particles. The electrical characteristics of the composite dielectric material can be selectively varied by applying an electric stimulus and/or a magnetic stimulus.

The stimulus generator 115 can be a device capable of generating a specified energetic stimulus. Energetic stimuli can include a photonic stimulus, a thermal stimulus, an electrical stimulus, and/or a magnetic stimulus. Application of the energetic stimulus via the stimulus generator 115 will result in a change in at least one electrical characteristic of the dynamic material of the radome 110.

The stimulus controller 120 can include a plurality of components for directing the energetic stimulus produced by the stimulus generator 115. The components can include electromechanical devices, electro-optical devices, electronic devices, and/or any other devices suitable for physically positioning the stimulus generator 115 or otherwise directing an energetic stimulus to a selected portion of the radome 110.

One or more sensors 122, can detect one or more parameters which can affect performance characteristics of the radome 110. A variety of signal based parameters can be detected by the sensor 122 that can include an incident angle for the incoming wave 140, a magnitude for the incoming wave 140, and angle of transmittal for the transmitted wave 142, a magnitude for the transmitted wave 142, and the magnitude for the reflected wave 144. Other environmental parameters that the sensor 122 can detect include a reflection coefficient for the radome 110, a transmission coefficient for the radome 110, and a radome 110 temperature. Further, the sensor 122 can detect conditions relating to the application of the energetic stimulus, such as the magnitude of the applied stimulus, the duration of the stimulus, and the application area relative to the radome 110.

The sensor 122 can be disposed inside or outside the radome 110. Further, multiple sensors 120 can exist within the system 100. For example, a first sensor outside the radome 110 can detect the magnitude of the incoming wave 140 and a second sensor inside the radome 110 can detect the magnitude of the transmitted wave 142. Using parameters from the first and second sensors, the ratio of received to transmitted electromagnetic energy, commonly referred to as $S_{21}$ value, can be calculated.

The control processor 125 can be implemented as a standalone or distributed computing device or devices and can contain both hardware and software components. The control processor 125 can be communicatively linked to the stimulus generator 115, the stimulus controller 120, and the sensor 122. Further, the control processor 125 can initiate control actions that can functionally control operational settings of the communicatively linked devices. Accordingly, the control processor 125 can receive parameters from the sensor 122, perform calculations to determine desired electrical characteristics for the radome 110 or portions thereof, and responsively trigger energetic stimuli necessary to achieve the computed electrical characteristics. Further, feedback information gathered from the sensor 122 can be utilized by the control processor 125 to automatically adjust applied stimuli.

Those skilled in the art will appreciate that the present invention is not limited to the particular control system arrangement illustrated in FIG. 1. Instead, any suitable combination of control system processing and stimulus generating components can be used to perform the above specified functions.

Figure 2A:
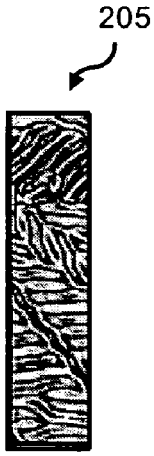
FIG. 2A is an enlarged section showing a dynamic material comprising a liquid crystal polymer that is useful for understanding an embodiment of the invention.

In one embodiment, the dynamic material for the radome 110 can be formed from a liquid crystal polymer (LCP). FIG. 2A shows an enlarged section of the radome 110 where the dynamic material is a liquid crystal polymer (LCP) 205. LCP 205 can have electrical characteristics that are highly responsive to a variety of energetic stimuli, such as a photonic stimulus, a thermal stimulus, an electric stimulus, and/or a magnetic stimulus. Before detailing the manner in which electrical characteristics of the LCP 205 change for each applied stimulus, it is useful to describe the general structure of the LCP 205.

The liquid crystal state of the LCP 205 is a distinct phase of matter, referred to as a mesophase, observed between the crystalline (solid) and isotropic (liquid) states. Liquid crystals are generally characterized as having long-range molecular-orientational order and high molecular mobility. There are many types of liquid crystal states, depending upon the amount of order in the dynamic material. The states of the LCP 205 can include a nematic state, a smectic state, and a cholesteric state.

The nematic state is characterized by molecules that have no positional order but tend to point in the same direction (along the director). As the temperature of this material is raised, a transition to a black, substantially isotropic liquid can result.

The smectic state is another distinct mesophase of liquid crystal substances. Molecules in this phase show a higher degree of translation order compared to the nematic state. In the smectic state, the molecules maintain the general orientational order of nematics, but also tend to align themselves in layers or planes. Motion can be restricted within these planes, and separate planes are observed to flow past each other. The increased order means that the smectic state is more solid-like than the nematic. Many compounds are observed to form more than one type of smectic phase.

Another common liquid crystal state can include the cholesteric (chiral nematic) state. The chiral nematic state is typically composed of nematic mesogenic molecules containing a chiral center that produce intermolecular forces that favor alignment between molecules at a slight angle to one another. Columnar liquid crystals are different from the previous types because they are shaped like disks instead of long rods. A columnar mesophase is characterized by stacked columns of molecules.

The structure of the LCP 205 can result in the LCP 205 being responsive to photonic and thermal stimuli. The name given to LCP 205 responses to heat, which can be generated by either a photonic or a thermal stimulus, can be referred to as thermotropic responses.

The LCP 205 can also be highly responsive to applied electric stimuli. The LCP 205 can produce differing responses based on the orientation of the applied electric fields relative to the director axis of the LCP 205. For example, applying a DC electric field to the LCP 205 having a permanent electric dipole can cause the electric dipole to align with the applied DC electric field. If the LCP 205 did not originally have a dipole, a dipole can be induced when the electric field is applied. This can cause the director of the LCP 205 to align with the direction of the electric field being applied.

Electrical characteristics of the LCP 205, such as the relative permittivity of the LCP 205, can be controlled by selectively applying the electric field. Only a very weak electric field is generally needed to control the electrical characteristics of the LCP 205. In contrast, applying an electric field to a conventional solid has little effect because the molecules are held in place by their bonds to other molecules. Similarly, in conventional liquids, the high kinetic energy of the molecules can make orienting a liquid's molecules by applying an electric field very difficult.

The LCP 205 can additionally be highly responsive to applied magnetic stimuli. The responsiveness to magnetic stimuli within the LCP 205 can be attributed to magnetic dipoles within the LCP 205. The magnetic dipoles align themselves in the direction of an applied magnetic field. If no inherent magnetic dipoles exist within the LCP 205, magnetic dipoles can be induced in the LCP 205 by applying a magnetic field. Accordingly, the relative permeability of the LCP 205 can be selectively adjusted by applying a magnetic stimulus to the LCP 205.

Examples of specific LCPs that can be used for the dynamic material of the radome can include a polyvinylidene fluoride polymer, a ferrite functionalized polymer, a fluorinated polystyrene polymer, and/or a polystyrene copolymer. However, the invention is not limited in this regard and any other LCP 205 having electrical characteristics responsive to energetic stimuli can also be used.

Figure 2B:
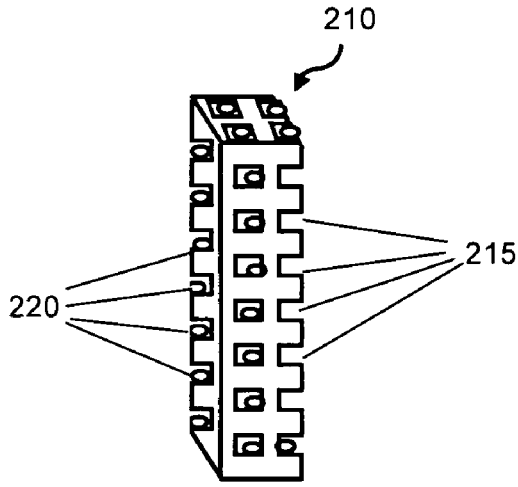
FIG. 2B is an enlarged section showing a dynamic material comprising a composite dielectric material that is useful for understanding an embodiment of the invention.

Referring to another embodiment of the present invention, the dynamic material for the radome 110 can be a composite dielectric including magnetic particles. FIG. 2B shows an enlarged section of the composite dielectric material 210. Each of the magnetic particles 220 within the composite dielectric material 210 can represent additional material added to a base dielectric layer material to achieve desired electrical characteristics for the composite dielectric material 210. The composite dielectric material 210 is a dynamic material having electrical characteristics that can be selectively altered by applying energetic stimuli. Additionally, as defined herein a magnetic particle 220 can include materials that have a significant magnetic permeability, which refers to a relative magnetic permeability of at least 1.1. Magnetic particles 220 can include ferroelectric materials, ferromagnetic materials, and/or ferrite materials.

Appropriate base dielectric materials for the dielectric material 210 can be obtained from commercial manufacturers, such as DuPont and Ferro. For example, a variety of suitable unprocessed base dielectric material, commonly called Green Tape™, can include Low-Temperature Cofire Dielectric Tape provided by Dupont, material ULF28–30 provided by Ferro, and Ultra Low Fire COG dielectric material also provided by Ferro. However, other base materials can be used and the invention is not limited in this regard.

Appropriate ferroelectric materials, which contain microscopic electric domains or electric dipoles, exhibit a hysteresis property so that the relationship between an applied electric field and the relative dielectric constant of the dynamic material is non-linear. Therefore, the application of an electric field to a ferroelectric material results in a change in the relative permittivity of the ferroelectric material. Ferroelectric compounds include, for example, potassium dihydrogen phosphate, barium titanate, ammonium salts, strontium titanate, calcium titanate, sodium niobate, lithium niobate, tunsten trioxide, lead zirconate, lead hafnate, guanidine aluminium sulphate hexahydrate, and silver periodate.

Appropriate ferromagnetic materials, which contain microscopic magnetic domains or magnetic dipoles, can form a hysteresis loop when selected energetic stimuli are applied to create an applied magnetic field across the dynamic material. The hysteresis loop being a well known effect associated with an applied magnetic field. The hysteresis loop results from a retardation effect based upon a change in the magnetism of the dynamic material lagging behind changes in an applied magnetic field. Accordingly, the relative magnetic permeability of a ferromagnetic material can be altered through the application of a magnetic field. Ferromagnetic materials include, for example, cobalt, iron, nickel, samarium, and mumetal.

Ferrites are a class of solid ceramic materials with crystal structures formed by sintering at high temperatures stoichiometric mixtures of selected oxides, such as oxygen and iron, cadmium, lithium, magnesium, nickel, zinc, and/or with other materials singularly or in combination with one another. Ferrites typically exhibit low conductivities and can possess a magnetic flux density from 0 to 1.4 tesla when subjected to a magnetic field intensity from minus 100 A/m to plus 100 A/m. Ferrites exhibit alterable electrical characteristics when a magnetic field is applied to the ferrite.

The composite dielectric material 210 can have a uniform set of effective electrical characteristics applicable for the composite dielectric material 210 and/or a predefined segment thereof. To achieve effective electrical characteristics, the differing materials contained within the composite dielectric material 210 are intermixed at a level that is small compared to the size of wavelengths of selected radio frequency waves passing through the composite dielectric material 210. That is, whenever the size of intermixed particles is at most one-tenth of a wavelength and preferably one-hundredth of a wavelength or less, the composite dielectric material 210 can possess uniform effective electrical characteristics.

The effective electrical characteristics of the composite dielectric material 210 results from the electromagnetic interaction of material components within the composite dielectric material 210 having positive permittivity and permeability values. The electromagnetic interaction can be in the form of electromagnetic coupling between voids 215, surface currents, coupling between magnetic particles 220 and the walls of the voids 215, and other physical phenomenons which can produce controlled and uncontrolled radiation as the result of the said electromagnetic interactions. Such physical processes are very similar to the physical processes found in frequency selective surfaces, except that the composite dielectric material 210 can have resonant and non-resonant array metallic and/or magnetic elements placed in a three-dimensional lattice, and the material properties can be changed at localized portions of the material.

In one embodiment, the composite dielectric material 210 can be a metamaterial. A metamaterial refers to composite materials formed from the mixing or arrangement of two or more different materials at a very fine level, such as the angstrom or nanometer level. Metamaterials allow tailoring of electrical characteristics of the composite dielectric material 210, which can be defined by effective electromagnetic parameters comprising effective electrical permittivity $\epsilon_{eff}$ (or dielectric constant) and the effective magnetic permeability $\mu_{eff}$.

Various techniques can be used to construct the composite dielectric material 210, including the use of voids 215 and magnetic particles 220. Voids 215 can provide low dielectric constant portions within the composite dielectric material 210 since voids 215 generally fill with air, air being a very low dielectric constant material. Other voids 215 can be filled with a filling material resulting in portions of the composite dielectric material 210 having tailored dielectric properties that differ from the bulk properties of the base dielectric material. The fill material can include a variety of materials which can be chosen for desired physical properties, such as electrical, magnetic, or dielectric properties.

Voids 215 can be created within the composite dielectric material 210 in a variety of ways. For example, photonic radiation can be used to create voids 215 using various mechanisms, such as polymeric end group degradation, unzipping, and/or ablation. A $CO_2$ laser is preferred when creating voids 215 by utilizing a laser. Voids 215 can occupy regions as large as several millimeters in area or can occupy regions as small as a few nanometers in area.

The voids 215 can be selectively filled by magnetic particles 220 in a variety of manners. Magnet particles 220 can be metallic and/or ceramic particles and can have sub-micron physical dimensions. Particle filling may be provided by microjet application mixing techniques known in the art, where a polymer intermixed with magnetic particles 220 is applied to voids 215. An optional planarization step may be added if filling initially results in a substantially non-planar surface and a substantially planar surface is desired.

The selection and placement with which the magnetic particles 220 are incorporated into the composite dielectric material 210 can determine the electrical characteristics of the composite dielectric material 210. The magnet particles 220 can be uniformly distributed or can be otherwise dispersed (e.g. randomly distributed) within the composite dielectric material 210.

Some specific examples of suitable magnetic particles 220 having dynamic properties as described herein can include ferrite organoceramics ($Fe_x$CyHz)-(Ca/Sr/Ba-Ceramic) materials and niobium organoceramics (NbCyHz)-(Ca/Sr/Ba-Ceramic) materials. However, the invention is not limited in this regard and any other dynamic composite material can also be used.

Regardless of the selected composition of the dynamic material forming at least a portion of the active radome, at least one of the electrical characteristics of the dynamic material can be altered through the application of an energetic stimulus. Further, while alterations of any of the electrical characteristics of the dynamic material forming the active radome can modify the transmissive and/or performance characteristics of the active radome, the permeability and the permittivity of the dynamic material can be particularly significant. Accordingly, the composition of the dynamic material and associated energetic stimuli are preferably selected so that a change in the permeability and/or the permittivity of the dynamic material results from the application of the energetic stimuli.

That is, the ratio of a permeability $\mu_1$ and a permittivity $\epsilon_1$ of the dynamic material relative to the ratio of permeability $\mu_2$ and a permittivity $\epsilon_2$ of an adjacent medium, such as free space, can affect the performance characteristics of the active radome. When an incoming wave is at normal incidence, the reflected wave can be minimized whenever $\mu_2\epsilon_1=\mu_1\epsilon_2$. Further, when the incoming wave is non-normal with an incident angle A and an angle of transmission B, the reflected wave can be minimized whenever $(\mu_2/\epsilon_2)^{1/2}*\cos A=(\mu_1/\epsilon_1)^{1/2}*\cos B$. Accordingly, the composition of the dynamic material and energetic stimuli can be selected so that suitable permeability and permittivity ratios can be established.

The application of the energetic stimulus to a selected dynamic material can alter the electrical characteristics of the dynamic material in a temporary or a substantially permanent manner. A temporary change in the dynamic material can require the energetic stimulus to be continuously reapplied to the dynamic material or else the electrical characteristics of the dynamic material will rapidly revert to a default state. A substantially permanent change in the electrical characteristics of the dynamic material, however, can result in fixed or stable conditions whenever an energetic stimulus is applied. The established state for the dynamic material will remain fundamentally unchanged until the next application of an energetic stimulus alters the electrical properties of the dynamic material.

Just as an applied energetic stimulus can alter electrical characteristics of the dynamic material forming the radome, transmitting RF energy through the radome can alter the electrical characteristics of the dynamic material of the radome. The alterations can be minimal, even negligible, when the electromagnetic device contained within the active radome functions as a receiving device. When the electromagnetic device contained within the active radome functions as a transmitting device, however, the alterations of the electrical characteristics can be significant. Accordingly, it can be preferable in such cases to use a dynamic material that is responsive to photonic and/or thermal energetic stimuli, such as a laser stimulus or an infra-red stimulus.

Figure 3A:
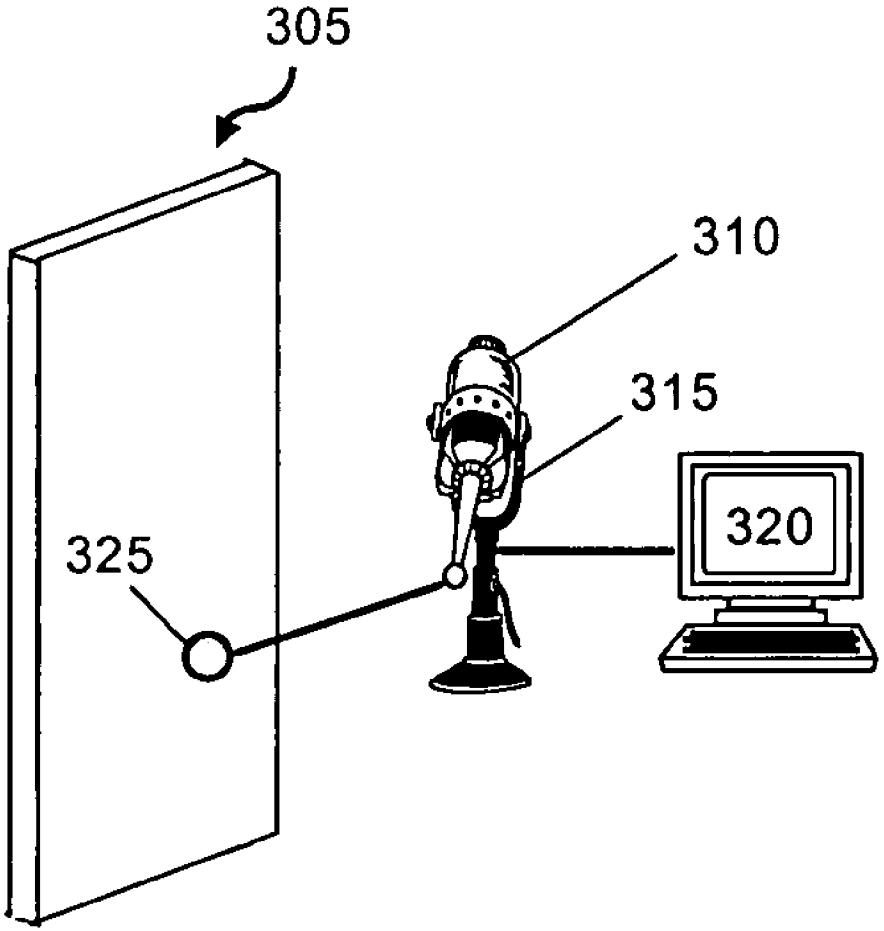
FIG. 3A is a schematic diagram illustrating a system for applying a photonic stimulus to the active radome of FIG. 1.

One embodiment of the present invention shown in FIG. 3A can apply a photonic stimulus to a dynamic material, such as an LCP. Referring to FIG. 3A, such an embodiment can include a radome 305 comprising a dynamic material that has electrical characteristics which are responsive to photonic radiation, a stimulus generator 310, a stimulus controller 315, and a control processor 320. The stimulus generator 310 can be selected to generate any suitable type of photonic radiation such as visible, near-infrared, and/or infrared radiation. The stimulus generator 310 can be provided by a laser source due to the laser's ability to produce a narrow, controllable, and highly coherent beam. In most instances, application of photonic radiation via the stimulus generator 310 will result in a temporary change in the dynamic material. In order to sustain the altered electrical characteristics within the dynamic material, the photonic radiation can be rapidly reapplied to the dynamic material so that the dynamic material cannot revert to its default state having default electrical characteristics.

The stimulus controller 315 can direct the photonic radiation produced by the stimulus generator 310 to a specified region of the radome 305 referred to as the photonic target 325. For example, the stimulus controller 315 can include one or more mirrors or reflectors that can be positioned to direct the photonic radiation. The stimulus controller 315 can also include components, such as mechanically positionable platforms coupled to the stimulus generator 310 capable of physically positioning the stimulus generator 310 as desired. Further, the stimulus controller 315 can include photonic radiation lenses and/or other electro-optical devices for diffusing and/or concentrating the photonic radiation generated by the stimulus generator 310, thereby altering the radius of the photonic target 325.

The control processor 320 can include a one or more computing devices either standalone or distributed containing both hardware and software components configured to control the stimulus generator 310 and the stimulus controller 315. Accordingly, the control processor 320 can direct the stimulus generator 310 to produce photonic radiation at a selected intensity for a selected duration. Additionally, the control processor 320 can cause the stimulus controller 315 to position the photonic radiation to a predetermined photonic target 325 for a selected duration.

Care must be taken when applying photonic radiation to the dynamic material of the radome 305, since over exposure can result in a permanent change to a portion of the dynamic material. For example, if a laser is applied too long to a selected photonic target 325, a portion of the dynamic material within the photonic target 325 can be inadvertently destroyed. Safety algorithms and conditions can be programmed within the control processor 320 to prevent over exposure. Moreover, the control processor 320 can contain programming that can assure that photonic radiation is applied to the photonic target 325 for a duration long enough to temporarily alter electrical characteristics of the dynamic material in a non-destructive fashion.

As mentioned, application of the photonic radiation to the radome 310 produces a transient change in the electrical characteristics of the dynamic material in the area of the photonic target 325. In order to produce changes across a selected portion of the radome 305, the photonic radiation needs to be selectively applied across the that selected radome portion.

For example, the control processor 320 can direct photonic radiation generated by the stimulus generator 310 to strike the radome 305 at the designed photonic target 325. The control processor 320 can further cause the photonic target 325 to be rapidly moved across the dynamic material to form a predetermined pattern of applied photonic radiation. In one embodiment, the movement of the photonic target 325 can proceed from right to left and top to bottom systematically to cover a selected portion of the radome 305. Alternatively, the photonic target 325 can be moved in an interleaved pattern so that two passes are necessary to cover the selected portion of the radome 305, wherein even rows are stimulated in the first pass and odd rows are stimulated in the second pass.

A special case for applying photonic radiation to the radome 305 can result in the application of heat to the dynamic material. For example, the stimulus generator 310 can be an infrared laser source used to increase the temperature of the photonic target 325. Accordingly, the stimulus generator 310 can generate a thermal stimulus in addition to a photonic stimulus. Therefore, the system depicted in FIG. 3A can be utilized to apply a thermal stimulus to the radome 305.

Figure 3B:
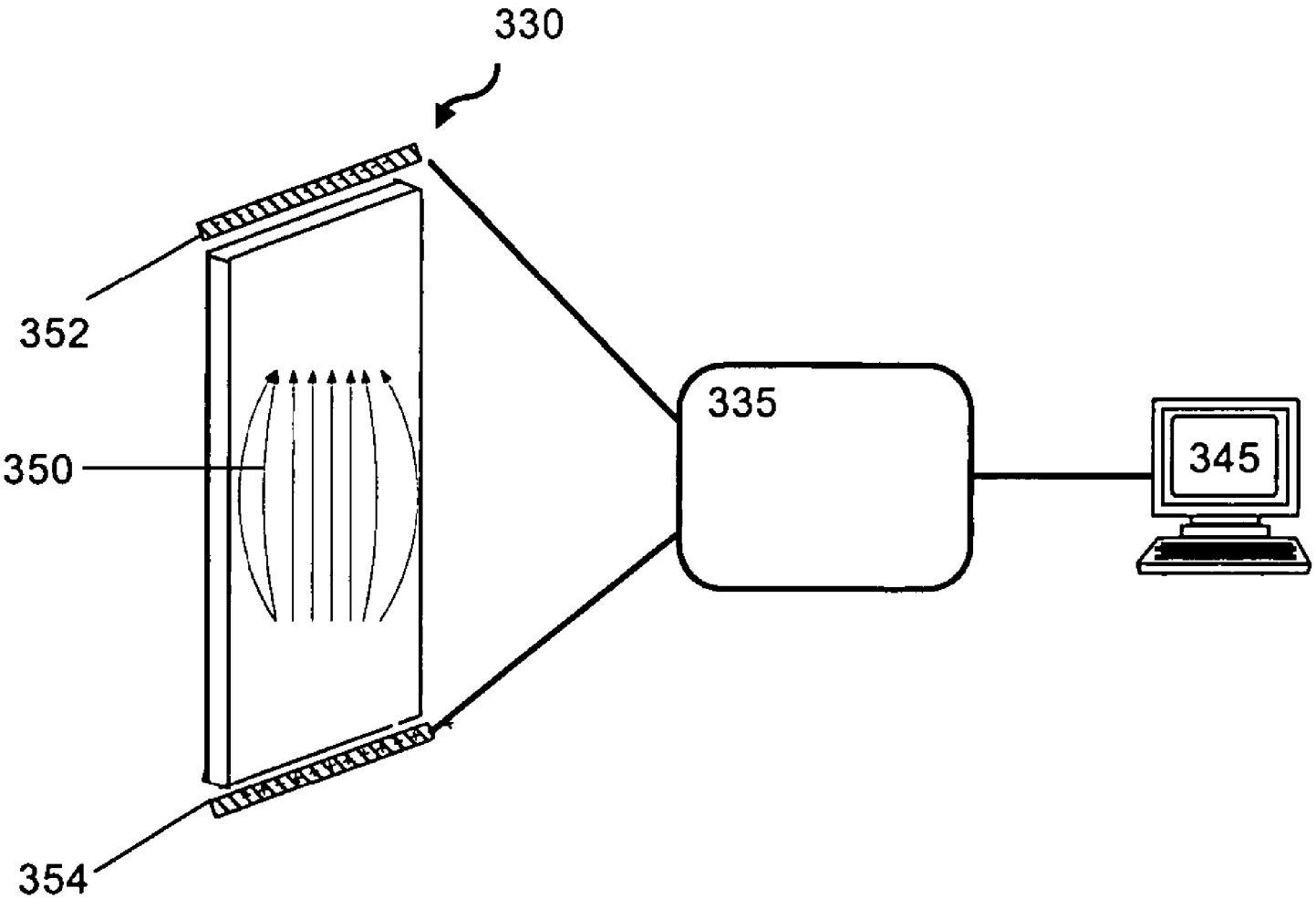
FIG. 3B is a schematic diagram illustrating a system for applying an electric stimulus to the active radome of FIG. 1.
Figure 3C:
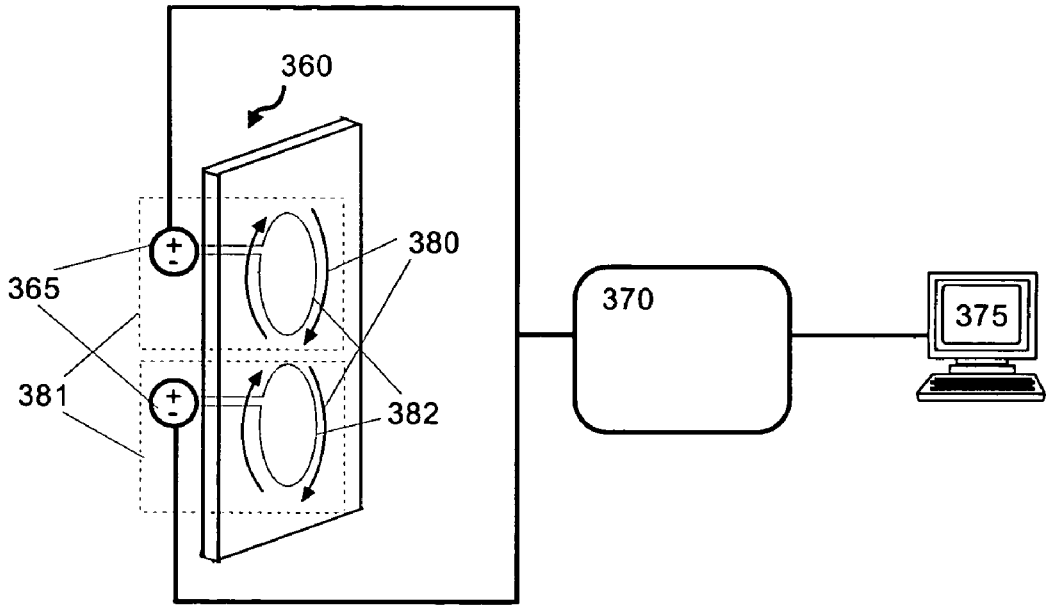
FIG. 3C is a schematic diagram illustrating a system for applying a magnetic stimulus to the active radome of FIG. 1.

Another embodiment of the present invention shown in FIG. 3B can apply an electric stimulus to a dynamic material, wherein the dynamic material is a LCP and/or a composite dielectric material. Referring to FIG. 3B, such an electric stimulus embodiment can include a radome 330 comprising a dynamic material that has electrical characteristics which are responsive to an applied electric field. A stimulus generator 335 and a control processor 345 can also be provided.

The stimulus generator 335 can be a DC power source capable of generating an electric field 350 between a negatively charged plane 352 and a positively charged plane 354. The electric field 350 results from the difference potentials of negatively charged plane 352 and positively charged plane 354. The magnitude of the electric field 350 can be modified by adjusting voltage applied by the stimulus generator 335. Adjusting the electric field 350 can result in modifying the relative electrical permittivity of the dynamic material. In practice, the charged planes can preferably be spaced as wide apart as practicable so as to minimize any potential to perturb or otherwise interfere with RF signals transitioning the radome wall.

The stimulus generator 335 can additionally include stimulation control circuitry. Simulation control circuitry can comprise any suitable electrical circuit including, for example, microprocessors and/or software, which can be used to control the electric stimulus applied to the dynamic material. The control processor 345 can include hardware and software components capable of controlling the stimulus generator 335. For example, in one embodiment, the control processor 345 can be a electric stimulus management application residing on a computer that is communicatively linked to the stimulus generator 335. In such an example, the control processor 345 can be configured to selectively trigger software control actions within the stimulus generator 335 resulting in a selected electric field 350 being applied across the dynamic material.

Numerous operational considerations should be taken into account when designing the stimulus generator 335. More particularly, components of the stimulus generator 335 should be formed to minimize inadvertent wave perturbations.

For example, in one embodiment, the charged planes 352 and 354 can be relatively thin conductive planes located at radome panel boundaries. Accordingly, scatter loss, or energy loss resulting from wave reflections due to charged planes 352 and 354, can be minimized.

In another embodiment, electric field generation and electric field control circuitry can be embedded within the dynamic material. When embedded, the circuitry should be small enough so that that the circuitry does not induce significant perturbations in the radio frequency signals passing through the radome 330. Therefore, the dimensions of the embedded circuitry should not exceed the size of one tenth of a wavelength, wherein the wavelength of the smallest wavelength of selected radio frequency signals which pass through the radome 330. More preferably, the dimensions of the embedded circuitry should not exceed one-hundredth the size of a wavelength.

Another embodiment of the present invention shown in FIG. 3E can apply a magnetic stimulus to a dynamic material, wherein the dynamic material is a LCP and/or a composite dielectric material. Referring to FIG. 3E, such a magnetic stimulus embodiment can include a radome 360 formed of a dynamic material that has electrical characteristics which are responsive to an applied magnetic field. A stimulus controller 370 and a stimulus processor 375 can also be provided. Further, the radome 360 can include a plurality of sections 381, each section configured to generate a predefined magnetic field 380.

Current from the stimulus generator 365 flowing through the current conducting line 382 results in the generation of a magnetic field 380. The magnetic field 380 can be selectively adjusted by adjusting the current provided by stimulus generator 365. Adjusting the magnetic field 382 results in modifying the relative magnetic permeability of the radome 360.

The stimulation controller 370 can include any suitable electrical circuit, including microprocessors and/or software components that can be used to control the magnetic stimulus applied to the dynamic material. The control processor 375 can include hardware and software components capable of controlling the stimulus generator 365 and the stimulus controller 370. For example, in one embodiment, the control processor 375 can be a magnetic stimulus management application residing on a computer that is communicatively linked to the stimulus generator 365 and the stimulus controller 370. The control processor 375 can selectively trigger software control actions within the stimulus generator 365 and the stimulus controller 370, thereby generating and controlling the magnetic field 382

As previously mentioned in connection with the electric stimulus embodiment, operational considerations should be taken into account when determining an application means for the magnetic fields. More particularly, the magnetic fields must be generated in a manner that minimizes reflections in radio frequency signals resulting from field generating components, such as components of the stimulus generator 365 and/or the stimulus controller 370.

Figure 4:
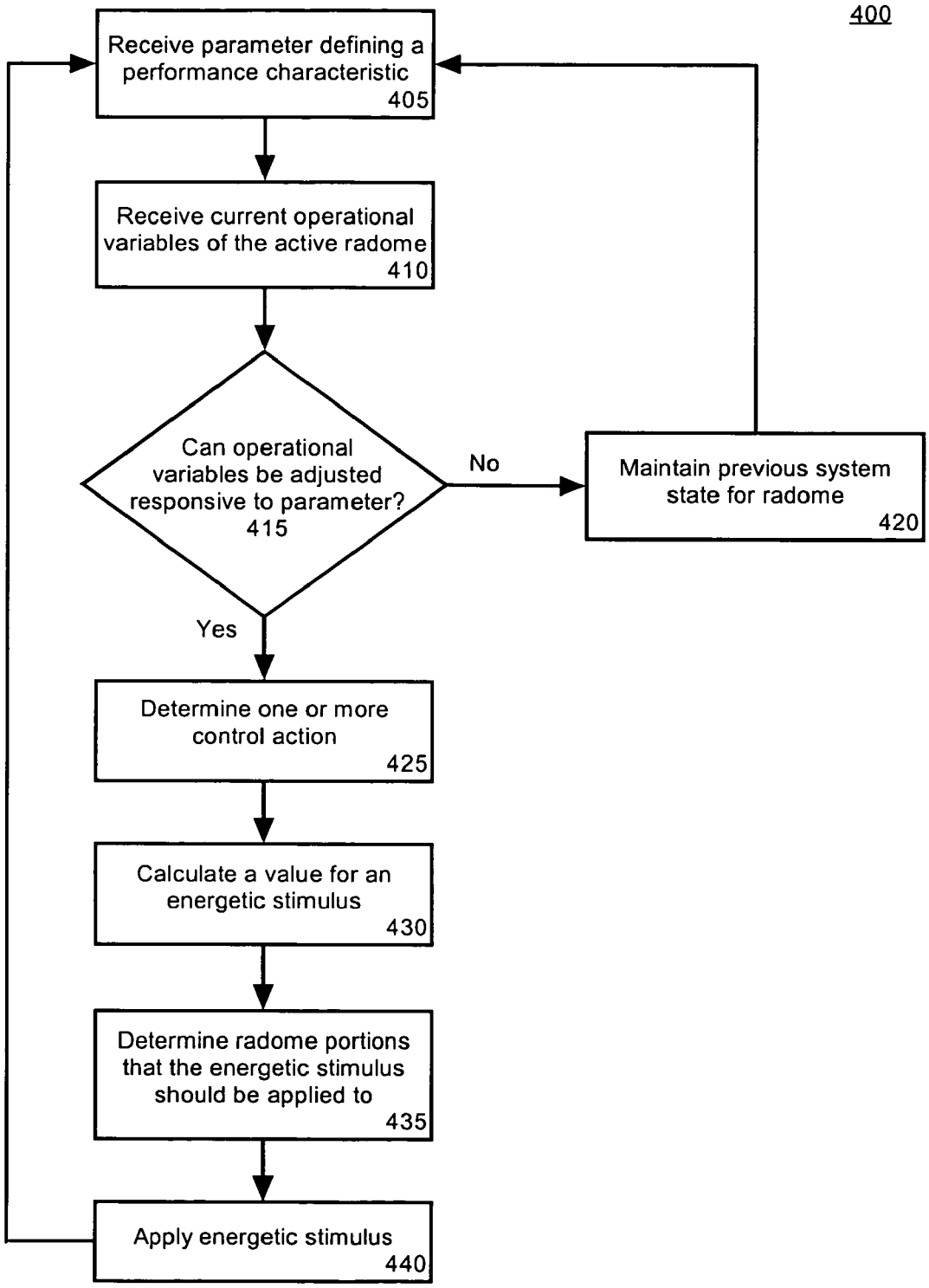
FIG. 4 is a flow chart illustrating an exemplary feedback and control mechanism using the system of FIG. 1.

FIG. 4 is a flow chart illustrating a method 400 of utilizing an active radome including feedback and control system. In step 405, a parameter defining a performance characteristic for a radome can be received. For example, the parameter can be used to determine the ratio of received to transmitted radio frequency waves ($S_{21}$ measurement) using sensors that detect waves on opposing sides of a radome wall. In step 410, parameters signifying the current operational state of the active radome can be received and examined. For instance, the system can determine what current energetic stimuli are being applied to a radome. The system can also monitor values for relative permittivity and permeability for the radome wall and adjacent media. In step 415, a determination can be made as to whether operational adjustments are possible and/or desirable. For example, if the $S_{21}$ measurement is within predefined limits, no change would result. However, if the $S_{21}$ measurement is outside the predefined limits, appropriate adjustments can be determined. Further, if electrical characteristics are presently adjusted to a maximum level and if the parameter indicates a further adjustment, step 415 can determine that no adjustment is possible.

If no adjustments are indicated in step 415, the method can proceed to step 420, where the previous state of the system can be maintained. This previous state can be one where a constant energetic source is being applied as well as a state where no energetic source is applied. For example, the previous state can apply a constant current to elements within the radome resulting in a specified electric field being generated. Such a state would not be altered in step 420. Once step 420 is completed, the method can proceed to step 405.

If changes are to be made in step 415, the method can proceed to step 425, where one or more control actions can be determined. In step 430, a value for an energetic stimulus can be calculated. In step 435, portions of a radome can be identified for receiving the calculated energetic stimulus. Further, a particular section of a dome wall can be modified by various energetic stimuli. In step 440, the selected energetic stimulus can be applied. The method can then proceed to step 405, where the feedback/control cycle continues.

Figure 5:
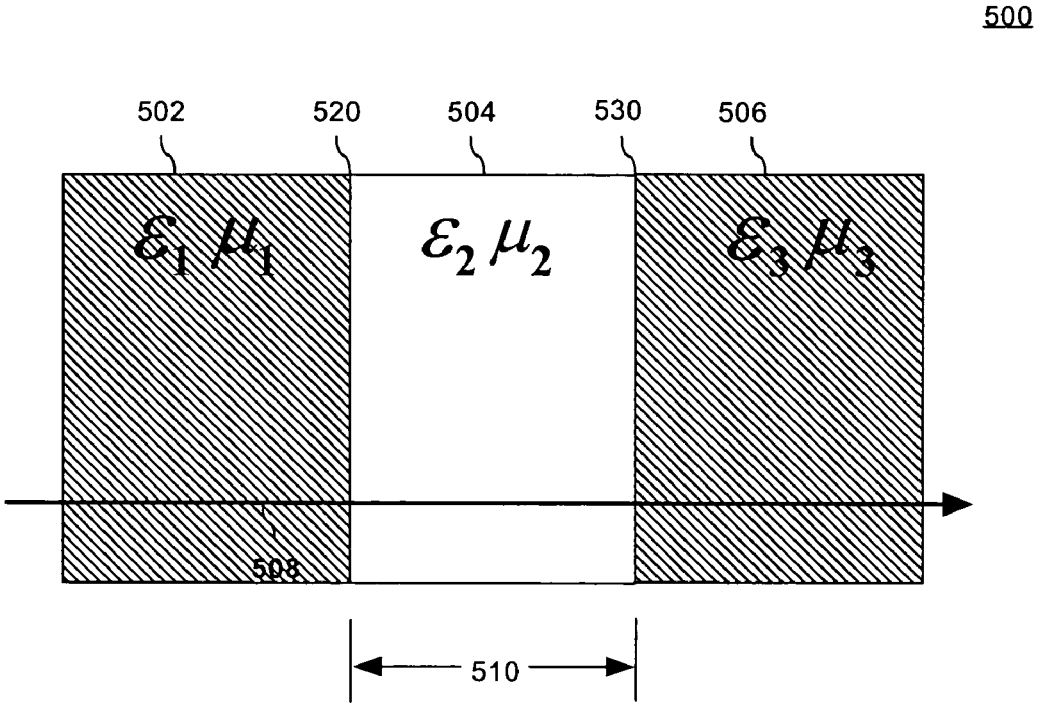
FIG. 5 is a schematic diagram illustrating a system including a wave at normal incidence passing across two boundaries separating three mediums.

FIG. 5 is a schematic diagram illustrating a system 500 including a wave 508 at normal incidence passing across two boundaries separating three mediums. The system 500 can include boundary 520 separating medium 502 and medium 504 and boundary 530 separating medium 504 and medium 506. Mediums 502, 504, and 506 have relative permittivity values of $\epsilon_1$, $\epsilon_2$, and $\epsilon_3$ and relative permeability values of $\mu_1$, $\mu_2$, and $\mu_3$, respectively.

Whenever the equation $\mu_2\epsilon_1=\mu_1\epsilon_2$ is satisfied, transmission of radio frequency waves at normal incidence can occur across boundary 520 without significant reflection, since the intrinsic impedance is identical in mediums 502 and 504. Similarly, when equation $\mu_2\epsilon_3=\mu_3\epsilon_2$ is satisfied, transmission of radio frequency waves at normal incidence can occur across boundary 530 without significant reflection, since the intrinsic impedance is identical in mediums 504 and 506. While, the above equations may not be dependant on length 510, observable loss will always occur as a function of length 510 resulting from non-zero electric and magnetic loss tangents. Accordingly, length 510 should generally be kept as short as possible.

For example, assume medium 502 and 506 are both air and that medium 504 is a radome wall. The relative permeability and permittivity of air is approximately one (1). Accordingly, $\mu_1$ and $\mu_3$ are approximately equal one (1) and $\epsilon_1$ and $\epsilon_3$ are approximately equal one (1). Assume that the exemplary radome wall, which is represented by medium 504, has an electrical permittivity of two (2). Thus, when the radome wall has a magnetic permeability of two (2), a wave 408 with a normal angle of incidence can be transmitted across boundary 520 without significant reflection. Furthermore in this example, because medium 502 and medium 506 are equivalent dielectric mediums (both air), boundary 530 will also be impedance matched, since the intrinsic impedance is identical in mediums 504 and 506.

The relationship for complete transmission across an ideal boundary 520 for an ideal wave 508 at normal incidence can be determined as follows. The intrinsic impedance ($\eta$) for a given medium can be defined as $\eta=(\mu/\epsilon)^{1/2}$ so that the intrinsic impedance for medium 502 is $\eta_1=(\mu_1/\epsilon_1)^{1/2}$ and intrinsic impedance for medium 504 is $\eta_2=(\mu_2/\epsilon_2)^{1/2}$. Next, the reflection coefficient ($\lceil$) for a plane wave 510 normal to boundary 520 can be defined as $\lceil=(\eta_2-\eta_1)/(\eta_2+\eta_1)$. All energy can be transmitted across boundary 520 if the reflection coefficient is zero; that is $$\lceil=(\eta_2-\eta_1)/(\eta_2+\eta_1)=0.$$

Using the above formulas, the following calculations can be made:

$$(\eta_2-\eta_1)/(\eta_2+\eta_1)=0 \quad (1)$$

$$(\eta_2-\eta_1)=0 \quad (2)$$

$$\eta_2=\eta_1 \quad (3)$$

$$(\mu_2/\epsilon_2)^{1/2}=(\mu_1/\epsilon_1)^{1/2} \quad (4)$$

$$(\mu_2/\epsilon_2)=(\mu_1/\epsilon_1) \quad (5)$$

$$\mu_2\epsilon_1=\mu_1\epsilon_2 \quad (6)$$

Equation (1) sets the reflection coefficient equation to zero. Equation (2) results from multiplying both sides of equation (1) by $(\eta_2+\eta_1)$. Equation (3) results from adding $\eta_1$ to both sides of equation (2). Equation (4) results from substituting in the defined values for $\eta_2$ and $\eta_1$ into equation (3). Squaring both sides of equation (4) results in equation (5). Equation (6) results from multiplying both sides of equation (5) by $(\epsilon_1\cdot\epsilon_2)$. Accordingly, when equation (6) is satisfied, an intrinsic impedance match between medium 502 and medium 504 can result. Accordingly, when equation (6) is satisfied, an intrinsic impedance match between medium 502 and medium 504 occurs so there is ideally no reflection loss for a wave 508 normally incident at boundary 520.

As seen in the above example, when $\mu_3\epsilon_1=\mu_1\epsilon_3$, matching the impedance of medium 504 to medium 502 at boundary 520 can result in an impedance match of medium 504 to medium 506 at boundary 530. However, when mediums 502 and 506 have dissimilar electrical permittivity and magnetic permeability values, it is not generally possible to perform an impedance match at boundaries 520 and 530 using the above formulas alone. In such a situation, additional impedance matching techniques can be utilized. Such techniques can be necessary when a medium 504 represents a single layer radome and the intrinsic impedance inside the radome (medium 506) is different than the intrinsic impedance outside the radome (medium 502). Additionally, such techniques can be necessary when a radome has multiple layers where medium 502 can represent a first layer, medium 504 can represent a second layer, and medium 506 can represent a third layer.

For example, assume medium 502 represents air, medium 504 the first layer of a radome, and medium 506 represents a second layer of a radome with permittivity and permeability values different from the first layer. In such a situation, the $\mu_2\epsilon_3=\mu_3\epsilon_2$ can be used to provide impedance matching at boundary 530. Assume that equation $\mu_1\epsilon_2=\mu_2\epsilon_1$ cannot be used to provide an impedance match at boundary 520 without disturbing the match at boundary 530. In this example, a medium between medium 504 and medium 506 can be added to provide a half wave transformer. The length of such a medium is a quarter of a wavelength at the frequency of operation.

Figure 6:
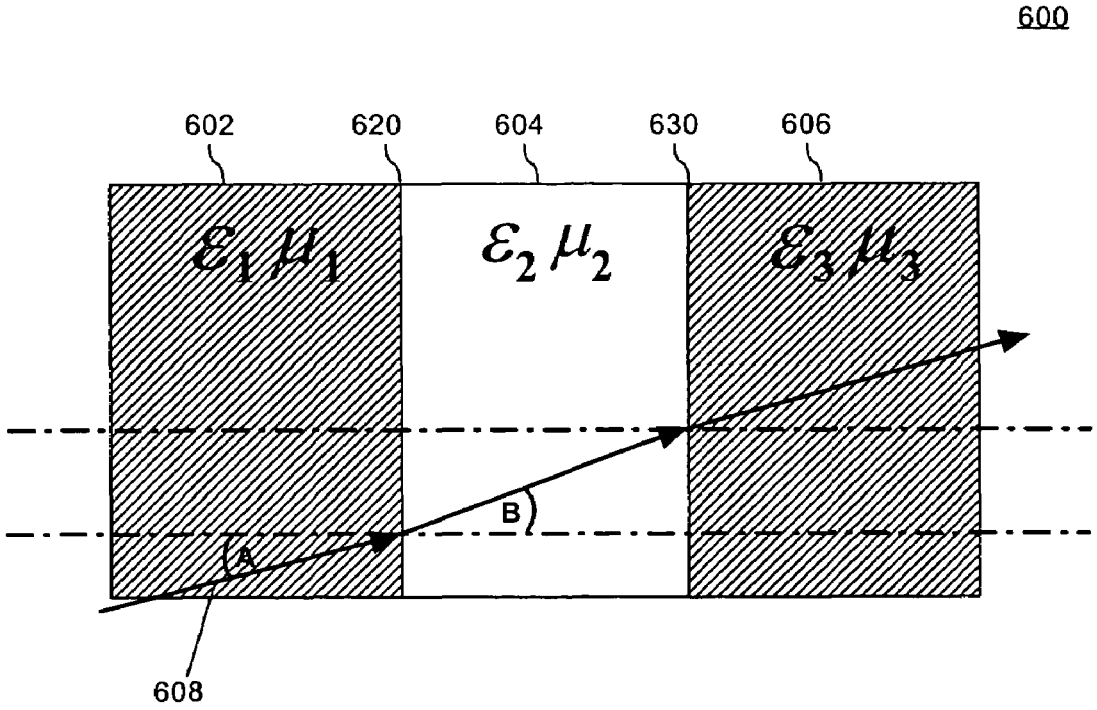
FIG. 6 is a schematic diagram illustrating a system including a wave at an angle of incidence different from normal incidence passing across two boundaries separating three mediums.

FIG. 6 is a schematic diagram illustrating a system 600 including a wave 608 at an angle of incidence different from normal incidence passing across two boundaries separating three mediums. System 600 can include medium 602, medium 604, medium 606, boundary 620, and boundary 630. Mediums 602, 604, and 606 can have relative permittivity values of $\epsilon_1$, $\epsilon_2$, and $\epsilon_3$ and can have relative permeability values of $\mu_1$, $\mu_2$, and $\mu_3$, respectively. An electromagnetic wave 608 is shown propagating in system 600 having an angle of incidence A and an angle of transmission B at boundary 620 related to the respective surface normal.

When equation $(\mu_1/\epsilon_1)^{1/2}\cdot\cos B=(\mu_2\epsilon_2)^{1/2}\cdot\cos A$ is satisfied for a perpendicularly polarized wave 608, transmission at normal incidence can occur across boundary 620 without any significant reflection. Similarly, when equation $(\mu_1/\epsilon_1)^{1/2}\cdot\cos A=(\mu_2\epsilon_2)^{1/2}\cdot\cos B$ is satisfied for parallel polarized wave 608, transmission occurs across boundary 620 without any significant reflection. These equations can be used to calculate a desired electrical permittivity and/or magnetic permeability for a given medium.

For example, assume medium 602 and 606 can be air (air has a relative permeability and permittivity value of approximately one) and assume that medium 604 can represent a radome wall with an electrical permittivity of two (2). Further assume that a plane wave is perpendicularly polarized and the angle of incidence, angle A, is 30° and that the desired angle of transmission, angle B, is 12.83°. Solving $(\mu_1/\epsilon_1)^{1/2}\cdot\cos B=(\mu_2/\epsilon_2)^{1/2}\cdot\cos A$ for $\mu_2$ can results in $\mu_2=(\mu_2\cdot\mu_{1)/}\epsilon_1)*(\cos B/\cos A)^2$. Substituting the values of angle A=30°, angle B=12.83°, $\mu_1=1$, $\epsilon_1=1$, and $\epsilon_2=2$ into the equation can result in an $\mu_2$ value of approximately 2.535.

$$\mu_2=(\varepsilon_2*\mu_{1)/}\varepsilon_1)*(\cos B/\cos A)^2 \quad (7)$$

$$=(2*1/1)*(\cos 12.83°/\cos 30°)^2 \quad (8)$$

$$=2*(.975/.866)^2 \quad (9)$$

$$=2*(1.2676)=2.535. \quad (10)$$

The relationship for complete transmission across a boundary for a wave at non-normal incidence was determined as follows. The intrinsic impedance ($\eta$) for a given medium can be defined as $\eta=(\mu/\epsilon)^{1/2}$ so intrinsic impedance for medium 602 can be $\eta_1=(\mu_1/\epsilon_1)^{1/2}$ and intrinsic impedance for medium 604 can be $\eta_2=(\mu_2/\epsilon_2)^{1/2}$. The reflection coefficient(⌈) for a perpendicularly polarized wave 608 striking boundary 620 with an angle of incidence A and an angle of transmission B can be defined as $\lceil_{perp}=(\eta_2*\cos A-\eta_1\cos B)/(\eta_2*\cos A+\eta_1*\cos B)*\rho_{perp}$, where $\rho_{perp}$ is a phase factor. For parallel polarization $\lceil_{par}=(\eta_2*\cos B-\eta_1\cos A)/(\eta_2*\cos B+\eta_1*\cos A)*\rho_{par}$.

Waves can be transmitted across boundary 620 if the reflection coefficient is zero, that is $\lceil_{perp}=0$ and $\lceil_{par}=0$, so $\lceil_{perp}=\lceil_{par}=0$. Using the above formulas, the following calculations can be made for $\lceil_{perp}$:

$$(\eta_2*\cos A-\eta_1\cos B)/(\eta_2*\cos A+\eta_1*\cos B)*\rho_{perp}=0 \quad (11)$$

$$(\eta_2*\cos A-\eta_1\cos B)/(\eta_2*\cos A+\eta_1*\cos B)=0 \quad (12)$$

$$(\eta_2*\cos A-\eta_1\cos B)=0 \quad (13)$$

$$\eta_2*\cos A=\eta_1\cos B \quad (14)$$

$$(\mu_2/\epsilon_2)^{1/2}*\cos A=(\mu_1/\mu_1)^{1/2}*\cos B \quad (15)$$

Equation (11) sets the reflection coefficient equation for perpendicular polarization to zero. Equation (12) results from dividing both sides of equation (11) by the phase factor, $\rho_{perp}$. Equation (13) results from multiplying both sides of equation (12) by $(\eta_2*\cos A+\eta_1*\cos B)$. Equation (14) results from adding $\eta_1\cos B$ to both sides of equation (3). Finally, equation (15) results from substituting in the defined values for $\eta_2$ and $\eta_1$ into equation (14). A similar derivation for $\lceil_{par}$ yields the equation $(\mu_2/\epsilon_2)^{1/2}*\cos B=(\mu_1\epsilon_1)^{1/2}\cdot\cos A$ for a parallel polarized wave 608.

One can similarly derive, from $\lceil_{par}$ the equation $(\mu_1/\epsilon_1)^{1/2}\cdot\cos A=(\mu_2/\epsilon_2)^{1/2}\cdot\cos B$ for a parallel polarized wave 608. The near lossless transmission across a magnetic radome can be generally obtained only for a range of angles about a selected angle of incidence. The loss, modeled with the phase factor, increases as the angle of incidence deviates from the angle optimized for low loss performance. This range of angles at which the radome loss is very small can be increased using multiple layers walls within a radome.

In one embodiment, a radome wall can be formed from a plurality of layers where at least one of the layers is not intrinsically impedance matched to the others. When a multilayered radome wall contains layers not intrinsically impedance matched some reflection can occur at the boundaries between wall layers. Losses resulting from the imperfect intrinsic impedance matching can be offset by the corresponding loss reductions attributable to the phase factor. The phase factor is a complex quantity, which depends on the angle of incidence A, the angle of transmission B, the thickness of the radome layer, and a propagation factor of the medium. In turn, the propagation factor of the medium depends on the frequency, and the frequency domain complex permittivity and complex permeability. The frequency domain permittivity is complex when the electric loss tangent is non-zero. The frequency domain permeability is complex when the magnetic loss tangent is non-zero. The permittivity and the permeability quantities are real when used in a time domain analysis, and complex, when used in a frequency domain analysis. An optimal tradeoff resulting in minimal loss at a given non-optimal angle of incidence can be mathematically calculated using formulas $\Pi_{perp}=(\eta_2*\cos A-\eta_1*\cos B)/(\eta_2*\cos A+\eta_1*\cos B)*\rho_{perp}$ and $\lceil_{par}=(\eta_2*\cos B-\eta_1*\cos A)/(\eta_2*\cos B+\eta_1*\cos A)*\rho_{par}$. Accordingly, multilayered radomes can reduce the overall losses attributable to differing angles of incidences.

The present invention can be embodied in other forms without departing from the spirit or essential attributes thereof. Accordingly, reference should be made to the following claims, rather than to the foregoing specification, as indicating the scope of the invention.

What is claimed is:

1. A method for dynamically optimizing radome performance, comprising the steps of:

sensing at least one parameter defining a performance characteristic of said radome;

selecting said parameter from the group consisting of a reflection coefficient, a transmission coefficient, a radome temperature, a polarization of incident waves, and an angle of wave incidence; and responsive to said sensing step, selectively varying at least one electrical characteristic of said radome to dynamically modify said performance characteristic.

2. The method according to claim 1, further comprising the step of:

selecting said performance characteristic to be a transfer characteristic.

3. The method according to claim 1, further comprising the step of:

selecting said parameter from the group consisting of an incident radio frequency signal, a reflected radio frequency signal, and a transmitted radio frequency signal.

4. The method according to claim 1, further comprising the step of:

varying said electrical characteristic for only a selected portion of said radome.

5. A method for dynamically optimizing radome performance, comprising the steps of:

sensing at least one parameter defining a performance characteristic of said radome;

responsive to said sensing step, selectively varying at least one electrical characteristic of said radome to dynamically modify said performance characteristic;

varying said electrical characteristic by application of an energetic stimulus to said radome; and selecting said energetic stimulus from the group consisting of an electrical stimulus, a photonic stimulus, a magnetic stimulus, and a thermal stimulus.

6. A radome, comprising:

a radome comprised of a dome wall, at least a portion of said dome wall comprised of magnetic material;

a sensor sensing at least one parameter defining a performance characteristic of said radome; and, a control system responsive to said sensor that selectively varies at least one electrical characteristic of said radome to dynamically modify said performance characteristic;

wherein said magnetic material includes at least one material selected from the group consisting of a ferroelectric material, a ferromagnetic material, a ferrite, and a liquid crystal polymer.

7. The radome according to claim 6, wherein said sensor senses a radio frequency energy.

8. A radome, comprising:

a radome;

a sensor sensing at least one parameter defining a performance characteristic of said radome; and, a control system responsive to said sensor that selectively varies at least one electrical characteristic of said radome to dynamically modify said performance characteristic;

wherein said parameter sensed by said sensor is selected from the group consisting of a reflected radio frequency energy, transmitted radio frequency energy, a radome temperature, a polarization of incident waves, and an angle of wave incidence.

9. A radome, comprising:

a radome;

a sensor sensing at least one parameter defining a performance characteristic of said radome; and, a control system responsive to said sensor that selectively varies at least one electrical characteristic of said radome to dynamically modify said performance characteristic;

wherein said electrical characteristic is selected from the group consisting of a permittivity, a permeability, a loss tangent, and a reflectivity.

10. The radome according to claim 9 wherein said control system further comprises a control processor configured to determine at least one control action based in part upon said parameter.

11. The radome according to claim 9 wherein said electrical characteristic is varied in response to an energetic stimulus.

12. A radome, comprising:

a radome;

a sensor sensing at least one parameter defining a performance characteristic of said radome; and, a control system responsive to said sensor that selectively varies at least one electrical characteristic of said radome to dynamically modify said performance characteristic, said electrical characteristic varied in response to an energetic stimulus;

wherein said energetic stimulus is selected from the group consisting of an electrical stimulus, a photonic stimulus, a magnetic stimulus, and a thermal stimulus.

13. A method for dynamically optimizing radome performance, comprising the steps of:

sensing at least one parameter defining a performance characteristic of said radome;

responsive to said sensing step, selectively varying at least one electrical characteristic of said radome to dynamically modify said performance characteristic;

selectively varying said electrical characteristic from the group consisting of a permittivity, a permeability, a loss tangent, and a reflectivity.

14. The method according to claim 13, further comprising the step of:

selecting said performance characteristic to be a transfer characteristic.

15. The method according to claim 13, further comprising the step of:

selecting said parameter from the group consisting of a reflection coefficient, a transmission coefficient, a radome temperature, a polarization of incident waves and an angle of wave incidence.

16. The method according to claim 13, further comprising the step of:

varying said electrical characteristic by application of an energetic stimulus to said radome.

* * * * *

UNITED STATES PATENT AND TRADEMARK OFFICE

CERTIFICATE OF CORRECTION

PATENT NO. : 7,088,308 B2
APPLICATION NO. : 10/681712
DATED : August 8, 2006
INVENTOR(S) : Delgado et al.

It is certified that error appears in the above-identified patent and that said Letters Patent is hereby corrected as shown below:

Column 14
Line 45, delete "$(\mu_2 / \varepsilon_2)^{1/2}$*cos $A$=$(\mu_1 / \mu_1)^{1/2}$*cos $B$" and replace with
-- $(\mu_2 / \varepsilon_2)^{1/2}$*cos $A$=$(\mu_1 / \varepsilon_1)^{1/2}$*cos $B$ --.

Column 15
Line 20, delete "$\Pi_{perp}$" and replace with -- $\Gamma_{perp}$ --.

Signed and Sealed this

Sixth Day of November, 2007

JON W. DUDAS
*Director of the United States Patent and Trademark Office*